United States Patent [19]

Lee

[11] Patent Number: 4,504,575

[45] Date of Patent: Mar. 12, 1985

[54] HEAT-DEVELOPABLE FILM CONTAINING SILVER SULFONATE PHYSICAL DEVELOPER

[75] Inventor: Ross A. Lee, Webster, N.Y.

[73] Assignee: E. I. Du Pont de Nemours and Company, Wilmington, Del.

[21] Appl. No.: 547,473

[22] Filed: Oct. 31, 1983

[51] Int. Cl.[3] ..... G03C 1/02

[52] U.S. Cl. ..... 430/531; 430/523; 430/619; 430/620; 430/569; 430/935; 430/627; 430/533; 430/536; 430/534

[58] Field of Search ..... 430/627, 617, 618, 619, 430/620, 531, 569, 935, 523, 533, 536, 534

[56] References Cited

U.S. PATENT DOCUMENTS

| | | | |
|---|---|---|---|
| 3,347,676 | 10/1967 | Cripps | 96/115 |
| 3,529,963 | 9/1970 | Marchese | 96/50 |
| 3,549,376 | 12/1970 | Roos | 96/92 |
| 3,632,342 | 1/1972 | Salesin et al. | 430/627 |
| 3,667,958 | 6/1972 | Evans | 430/619 |
| 4,069,759 | 1/1978 | Endo et al. | 101/467 |
| 4,144,072 | 3/1979 | Ikenoue et al. | 430/618 |
| 4,211,839 | 7/1980 | Suzuki et al. | 430/619 |
| 4,288,536 | 9/1981 | Goettert et al. | 430/619 |

*Primary Examiner*—Won H. Louie

[57] ABSTRACT

Novel heat-developable (photothermographic) films incorporate a silver alkyl sulfonate as a physical developer, and an organic base to neutralize acidity from the silver sulfonate. Preferably a heat-developable film is produced by coalescing a coating composition comprising a silver alkyl sulfonate, a silver halide emulsion as photocatalyst, a reducing agent, and an aqueous latex dispersion.

8 Claims, No Drawings

HEAT-DEVELOPABLE FILM CONTAINING SILVER SULFONATE PHYSICAL DEVELOPER

BACKGROUND OF THE INVENTION

1. Field of the Invention

The present invention relates to silver-containing films which develop upon being heated. In particular, the present invention relates to the use of a silver sulfonate as a physical developer in heat-developable films.

2. Discussion of the Prior Art

Heat-developable or photothermographic films ordinarily contain a silver salt, a photocatalyst, a reducing agent, and binder as the major components. The photocatalyst is usually a silver halide. The silver salt serves as a physical developer by supplying the silver which forms the visible image; the prior art has placed particular emphasis on the use of silver behenate and silver benzotriazole.

Silver alkanesulfonic acid salts are described in photopolymerizable and heat developable, compositions in U.S. Pat. Nos. 3,347,676 and 3,529,963. These patents do not suggest that such combinations would be applicable in silver halide speed thermographic films. U.S. Pat. No. 4,069,759 discloses silver 2-aminoethane sulfonate in a polyvinyl butyral dry process and silver system used for an electrostatic printing plate master. Japanese Patent Publication JA 52/018308 describes the use of silver fluoroalkane sulfonate in a dry silver system activated by infrared radiation.

In spite of the numerous publications in the field of heat-developable silver films, an enabling disclosure is lacking on how to employ novel physical developers such as silver sulfonates in such a system.

SUMMARY OF THE INVENTION

The present invention advances the art of heat-developable silver films by providing a photothermographic film comprising a silver salt as physical developer, a silver halide as photocatalyst, a reducing agent, and a binder, wherein the improvement comprises using a light-insensitive silver sulfonate as the physical developer in combination with an organic base which neutralizes acidity, and with an aqueous latex dispersion which serves as a coalescable binder. This provides a heat-developable film based upon an aqueous system.

A preferred embodiment of the present invention comprises (1) a support, (2) a coalesced coating thereon of silver dodecylsulfonate along with a silver halide emulsion photocatalyst and a reducing agent in a latex binder, and (3) an overcoat of pyridine in polyvinyl alcohol binder.

An improved process for preparation of silver dodecylsulfonate is also provided.

A process for producing heat-developable films according to the present invention consists of the steps of:

(a) preparing a light-insensitive silver sulfonate;

(b) dispersing the silver sulfonate in a polymer latex along with additional components to provide a heat-developable coating composition;

(c) coating the composition on a support;

(d) drying the composition to coalesce the latex which then serves as a binder;

(e) overcoating with an organic base in a binder; and (f) drying to produce a heat-developable film.

Optional step (a) above may consist of these substeps:

(1) oxidizing dodecyl mercaptan with potassium permanganate;

(2) separating potassium dodecylsulfonate;

(3) reacting with silver ion to produce silver dodecylsulfonate; and (4) purifying silver dodecylsulfonate.

DETAILED DESCRIPTION OF THE INVENTION

Silver dodecylsulfonate and silver hexadecylsulfonate represent light-insensitive silver salts which produce a strong acid upon reduction of silver ions to silver metal.

Silver dodecylsulfonate is conveniently prepared by $KMnO_4$ oxidation of the dodecyl mercaptan to produce potassium dodecylsulfonate which is then reacted with silver nitrate.

Silver hexadecylsulfonate is prepared similarly and requires, inter alia, reacting silver nitrate with potassium hexadecylsulfonate.

Hydroquinone and hydroquinonemonosulfonate potassium salt when added at one mole per mole of silver sulfonate represent preferred reducing agents. Phenidone (1-phenyl-3-pyrazolidone) and cuprous thiocyanate spontaneously develop the silver sulfonates.

The silver sulfonate can be partially converted to silver bromide by the addition of a soluble bromide to produce an in situ photocatalyst. The primitive silver bromide formed at 20% mole conversion is superior to a 10% mole conversion in terms of photospeed obtained.

In contrast to prior systems coated from organic solvents, the silver sulfonates of the present invention are coated from aqueous dispersions in which a latex plays a key role. The components of the heat-developable composition are first dispersed in a latex and then coated on a support. The latex particles thermally coalesce when the composition is dried. It is the coalesced latex which serves as the binder.

Suitable latices are the latices of poly(ethylacrylate), poly(butylmethacrylate/butylacrylate/hydroxymethylated acetone acrylamide) 90/5/5, poly(butylmethacrylate/butylacrylate/diacetone acrylamide) 85/10/5, etc. Nonionic and anionic surfactants are preferred with these latices, e.g., octylphenoxy poly(ethyleneoxy)ethanol, nonyl phenoxy poly(ethyleneoxy)ethanol sodium dodecyl sulfonate, and p-tertiary octyl phenoxyethoxyethyl sulfonate.

Hydrophilic binders may be used to avoid cracking of the dried composition. Polyvinylpyrrolidone and gelatin added up to 20 mole % of the latex polymer is effective for this purpose.

It is also well known in the art of heat-developable films to add a toner along with the silver salt, photocatalyst, and reducing agent in order to provide neutral black images. Suitable toners for the system of the present invention include phthalazinone, phthalimide, succinimide, and hydantoin, preferably phthalazinone when added with a surfactant compatible with that used in the latex.

In the coated composition of the present invention the heat-activated development of the silver sulfonate releases a strong acid, which can be buffered by overcoating the coalesced latex layer with an aqueous composition comprising 4% polyvinyl alcohol and 1% pyridine. With a dry overcoat the pH of the dried latex layer is increased from 2.5 to about 6.5. Other weak organic bases similar to pyridine have a similar effect.

Unlike the prior art films which employ silver behenate in polyvinyl butyral, the film of the present invention is based on an aqueous system and can be treated with aqueous solutions such as a fixer. While the rate is slow, it is possible to fix out the undeveloped silver sulfonate after heat development of the image. A surfactant addition to the fixer facilitates this process.

A preferred silver sulfonate for the practice of the present invention is silver dodecylsulfonate, which can be conveniently produced from inexpensive starting materials. A preferred latex is an acrylic latex, viz. butyl methacrylate/butyl acrylate/diacetone acrylamide 85/10/5, prepared by emulsion polymerization using Igepal® CA 890 surfactant, i.e., octylphenoxy poly(ethyleneoxy)ethanol. A preferred plasticizer for the latex binder is polyvinyl pyrrolidone. A preferred reducing agent is hydroquinone or hydroquinone monosulfonate potassium salt. A preferred photocatalyst silver halide prepared by conversion of the silver sulfonate. A preferred toner is phthalazinone. A preferred organic base buffer is pyridine.

The following examples serve to illustrate the practice of the present invention.

EXAMPLE 1

(A) Preparation of Potassium Dodecylsulfonate

A 5 l, 3-necked flask equipped with mechanical stirrer and reflux condenser was charged with 2 l of distilled water and 200 g dodecyl mercaptan (0.99 moles). 2 moles solid $KMnO_4$ was added slowly, and the solution was heated while being stirred for 3 hours. The bath temperature was adjusted to 80° C. and the heating continued for 2 more hours. When it was observed that the original purple color had been discharged. The mixture was cooled overnight, then reheated to 70° C. and the solid $MnO_2$ filtered off by gravity through a celite mat. The filtrate was cooled and the solid $K^+O_3{-}SC_{12}H_{25}$ collected and washed with water. A yield of 165 g (57%) was obtained.

(B) Preparation of Silver Dodecylsulfonate 100 g (0.35 moles) of the potassium dodecylsulfonate was dissolved in 3.5 l distilled water with heating to produce a 0.1 N solution. A 3 N solution of silver nitrate (117 ml) was diluted to 3.5 liters to provide a 0.1 N silver solution. These solutions were simultaneously pumped into 3.5 l of distilled water at a rate of 40 ml/min under yellow lights at room temperature. A white precipitate formed and was collected by suction, washed several times with water, stirred with methanol, and air dried to give 106 g (85%) silver dodecylsulfonate, $C_{12}H_{25}SO_3Ag$.

The purified salt did not darken when exposed to room light for 24 hours.

EXAMPLE 2

A first composition was prepared from the following:

(A)

30 ml of a latex containing 30% solid 85/10/5 butyl methacrylate/butyl acrylate/diacetone acrylamide and 3% Igepal® CA-890 surfactant, i.e., octylphenoxy poly(ethylene oxy) ethanol from GAF
2 g silver dodecylsulfonate
0.7 g polyvinylpyrrolidone, mol. wt. 30,000 PVP K30.

The latex, silver salt, and PVP were stirred until well mixed.

Powdered phthalazinone (0.8 g) was premixed with 0.15 g Triton® X-100, i.e., octyl phenoxy polyethoxy ethanol and then added to the mixture. The mixture was ball milled for one hour. The aqueous foam dispersion was drained off and allowed to settle.

A second composition was prepared from the following:

(B)

25 ml of a 10% aqueous solution of PVP K30
0.3 g limed bone gelatin
0.4 g $NH_4Br$.

These were mixed together at 38° C., and 4 ml of this solution was mixed with 0.6 g hydroquinone monosulfonate to become solution (B). 3 ml of (A) was mixed with 0.8 ml of (B).

Working under safelight conditions the mixture was stirred for 2 minutes at 35° C. to allow the silver dodecylsulfonate to be partially converted to silver bromide. The mixture was then coated with a 6 mil knife onto a polyethylene terephthalate support and dried at 35° C. The film was next overcoated with a solution of 50 mg pyridine in 5 ml of 4% polyvinyl alcohol containing 2 drops of Zonyl® FSN, a fluorocarbon surfactant (about 10 mg) and 1 drop Triton® X-100 (about 10 mg). The film was dried.

Film samples were exposed through a step wedge using four flashes of a 400 W Xenon strobe (Monolite®) at a distance of 15 cm. Film samples were heat developed on a hot platen at 93° to 115° C. for 5 to 10 seconds. Images were obtained with D max and D min in the range of $\geqq 1.2$ to $\leqq 0.15$ respectively. Attempts to use longer times or temperatures resulted in fog. A satisfactory image was obtained by placing an exposed film in 60° C. water for seven seconds. Developed samples slowly printed up under room lights. It was found that swabbing the developed samples with either 5% ethanolic phenylmercaptotetrazole or 5% ethanolic p-toluenesulfonic acid retarded the print-up.

EXAMPLE 3

Heat-developable films with satisfactory images were produced following the procedure in Example 2 except for the following substitutions: silver hexadecylsulfonate for silver dodecylsulfonate; polyethyacrylate or polymethylmethacrylate latex for butylacrylate latex; hydroquinone for hydroquinone monosulfonate; and substituted pyridines for pyridine.

EXAMPLE 4

When silver dodecylsulfonate was coated with polyvinyl butyral binder from an organic solvent and then overcoated with $NH_4Br$ (to form the photocatalyst) and polyvinylpyrrolidone followed by swabbing with ascorbic acid, a heat-developable film was produced. The results were poorer than in Example 2 since the samples exhibited higher D min.

This example illustrates that the silver sulfonates of the present invention can provide useful results when coated from either aqueous or organic solvent systems.

We claim:

1. A photothermographic film comprising a silver salt as physical developer, a silver halide as photocatalyst, a reducing agent, and a binder, wherein the improvement comprises using a light-insensitive silver sulfonate as the physical developer in combination with an organic base, and wherein the silver sulfonate is silver dodecylsulfonate or silver hexadecylsulfonate.

2. The film of claim 1 in which the binder is an acrylic latex.

3. The film of claim 1 in which the reducing agent is hydroquinone or hydroquinone monosulfonate.

4. The film of claim 1 in which the silver halide is a separately added gelatino-silver bromide emulsion.

5. The film of claim 1 in which the organic base is pyridine.

6. In combination, (1) a support, (2) a coalesced coating thereon of silver dodecylsulfonate along with a silver halide emulsion photocatalyst and a reducing agent in a latex binder, and (3) an overcoat of pyridine in polyvinyl alcohol binder.

7. A process for producing a heat-developable photothermographic film comprising the steps of;

(a) dispersing a light-insensitive silver sulfonate, a silver halide emulsion, and a chemical developing agent in a polymer latex to provide a coating composition;

(b) coating the composition on a support;

(c) drying the composition to coalesce the latex;

(d) overcoating with an organic base in a binder; and (e) drying to produce a heat-developable film.

8. The process of claim 7 wherein the light-insensitive silver sulfonate is prepared by (a) oxidizing dodecyl mercaptan with potassium permanganate; separating potassium dodecylsulfonate; reacting with silver ion to produce silver dodecylsulfonate; and purifying this product.

* * * * *